US006531693B1

(12) United States Patent
Focke et al.

(10) Patent No.: US 6,531,693 B1
(45) Date of Patent: Mar. 11, 2003

(54) METHOD FOR MONITORING THAT CIGARETTES GROUPS ARE COMPLETE AND THAT THE CIGARETTES ARE FILLED

(75) Inventors: Heinz Focke, Verden (DE); Michael Czarnotta, Bremen (DE)

(73) Assignee: Focke & Co., (GmbH & Co.), Verden (DE)

( * ) Notice: Subject to any disclaimer, the term of this patent is extended or adjusted under 35 U.S.C. 154(b) by 0 days.

(21) Appl. No.: 09/555,636

(22) PCT Filed: Nov. 17, 1998

(86) PCT No.: PCT/EP98/07360

§ 371 (c)(1),
(2), (4) Date: May 30, 2000

(87) PCT Pub. No.: WO99/28190

PCT Pub. Date: Jun. 10, 1999

(30) Foreign Application Priority Data

Dec. 2, 1997 (DE) ..... 197 53 333

(51) Int. Cl.[7] ..... H01J 40/14
(52) U.S. Cl. ..... 250/221; 250/223 R; 209/535
(58) Field of Search ..... 250/208.1, 223 R, 250/221, 559.04; 209/535, 536; 356/240.1

(56) References Cited

U.S. PATENT DOCUMENTS

| | | | | |
|---|---|---|---|---|
| 4,053,056 A | | 10/1977 | Day | 209/587 |
| 4,344,520 A | * | 8/1982 | Czoch et al. | 198/347.3 |
| 4,486,098 A | | 12/1984 | Buchegger et al. | 356/445 |
| 4,511,045 A | | 4/1985 | Seragnoliu | 209/535 |
| 4,644,150 A | * | 2/1987 | Kuga et al. | 250/223 R |
| 5,127,737 A | | 7/1992 | Neri | 356/394 |

FOREIGN PATENT DOCUMENTS

| | | | |
|---|---|---|---|
| DE | 1532268 | 11/1971 | |
| DE | 3201666 | 9/1982 | A24C/5/34 |
| DE | 3304299 | 9/1983 | A24C/5/32 |
| DE | 3822520 | 1/1990 | A24C/5/34 |
| DE | 4000658 | 8/1990 | A24C/5/34 |
| DE | 4100792 | 7/1992 | |
| DE | 4305328 | 5/1994 | B65B/57/04 |
| DE | 4302777 | 8/1994 | A24C/5/34 |
| DE | 4424045 | 1/1996 | A24C/5/34 |
| DE | 19535259 | 3/1997 | G01N/33/36 |
| EP | 0136092 | 4/1985 | B65B/19/30 |
| EP | 518141 | 12/1992 | B65B/19/30 |

OTHER PUBLICATIONS

European Search Report, dated Aug. 28, 2000.

* cited by examiner

*Primary Examiner*—Que T. Le
*Assistant Examiner*—Thanh X. Luu
(74) *Attorney, Agent, or Firm*—Abelman, Frayne & Schawab

(57) ABSTRACT

The invention relates to a method for checking that batches of cigarettes are complete and that the cigarettes are sufficiently filled. In spite of careful manufacturing, when cigarettes are produced and batches of cigarettes are filled in cigarette packs (11) using high-performance machines, it is possible that some of the packs of cigarettes manufactured have cigarettes missing or contain cigarettes which are not sufficiently filled with tobacco. The invention provides an improved, non-contact method of checking the batches of cigarettes or the individual cigarettes. According to this method, the intensity signal of a CCD camera or a CCD-line-scanning chip in subareas of the front ends (24) of the cigarettes and/or the spaces between them is measured and analysed in the front end area of the batch of cigarettes. The inventive method therefore provides a means of checking that batches of cigarettes are complete and that the cigarettes are sufficiently filled in high-performance machines such as pocket conveyors or revolving folders.

28 Claims, 9 Drawing Sheets

METHOD FOR MONITORING THAT CIGARETTES GROUPS ARE COMPLETE AND THAT THE CIGARETTES ARE FILLED

DESCRIPTION

The invention relates to a method for checking ordered cigarette groups corresponding to the content of a cigarette pack with an electro-optical checking element, preferably a CCD linear array chip or a CCD camera, connected to a signal data processing arrangement, for the measurement of the intensity of light reflected by filter-side ends of the cigarettes. Furthermore, the invention relates to a method for checking ordered cigarette groups corresponding to the content of a cigarette pack with an electro-optical checking element, preferably a CCD camera, connected to a signal data processing arrangement, for the measurement of the intensity of reflected light, a measurement zone preferably formed from pixels of the checking element being assigned to at least one partial area of the ends of the cigarettes.

High-performance machines are required to produce cigarettes and fill cigarette groups in cigarette packs. Despite careful manufacturing, however, it is often the case that the cigarette packs that have been produced and delivered to the customer have cigarettes missing or contain cigarettes inadequately filled with tobacco. When selecting checking methods for separating out such defective cigarette groups, it has to be taken into account that the checking must take place in a fast, continuous or batchwise conveying process.

In a checking method used previously, an ordered cigarette group corresponding to the content of a cigarette pack is moved past a checking device in which the intensities of reflected light which are measured by a CCD camera are statistically evaluated.

The invention is based on the object of proposing an improved, contactless checking method for monitoring that cigarette groups are complete and/or that the cigarettes are filled with tobacco.

In order to achieve this object, the method according to the invention is characterized in that a measurement zone formed by the checking element, preferably by the pixels of the CCD linear array chip or the CCD camera, is assigned to the ends of the cigarettes and the cigarette interspaces formed between the latter, at least partial areas of the measurement zone, in particular pixels of the CCD camera or of the CCD linear array chip, are arranged in curved or rectilinear, in particular horizontal or vertical, evaluation bars, and the measurement signal measured along the evaluation bars is evaluated in the signal data processing arrangement in order to check that the cigarette group is complete.

The measurement element for checking the cigarette groups thus operates contactlessly on the basis of a CCD linear array chip or a CCD camera, so that the cigarette group can be checked even with a fast conveying cycle. In this case, the measurement element can be arranged at any desired point in the conveying process as long as the ends of the cigarette groups are freely accessible in this. By way of example, the checking can be carried out during the conveying process in a pocket conveyor. A further possibility is for the cigarette groups to be checked in a folding turret.

According to the invention, in a further refinement with regard to the evaluation of the intensity profile yielded by the CCD camera or the CCD linear array chip, the method is characterized in that the number of cigarettes in the region of the evaluation bar or bars is determined from a count of the crossings of the intensity profile through a threshold value with the threshold value subsequently being exceeded and/or undershot. This evaluation method is based on the fact that the reflected light in the region of the light filter areas of the cigarettes is greater than the intensity measured in the region of the dark cigarette interspaces formed by adjacent cigarettes. A rise in the measured intensity profile can thus be evaluated as a transition from a cigarette interspace to a filter-side end of a cigarette. If a cigarette is missing in a row of cigarettes, the number of times that the high intensity is reached in the region of the filter areas is thus one fewer than in the case of a complete row of cigarettes. This is detected from the count of the crossings of the intensity profile through a threshold value.

If a cigarette is missing within a cigarette group with a plurality of rows of cigarettes, adjacent cigarettes are displaced. The consequence of this is that the distance between the first and last cigarettes in a row of cigarettes is reduced on account of a cigarette being missing. Therefore, a further method according to the invention is characterized in that the completeness of the cigarette group is determined from the comparison of the distance between the first and last crossings of the intensity profile through a threshold value with a desired value.

The number of high measured intensity values increases with the number of filter-side end areas of the cigarettes in the region of the evaluation bar of the CCD linear array chip or CCD camera. Accordingly, in a further method according to the invention, the area, determined in particular by summation of the intensity values measured along the evaluation bar, underneath the curve of the measured intensity signal can be compared with a desired value determined for the complete cigarette group.

In order to achieve the object, a further method according to the invention is characterized in that a measurement signal measured in the pixels assigned to the ends of the cigarettes and also the cigarette interspaces is evaluated in accordance with the horizontal and vertical positions of the pixels as a two-dimensional measurement zone.

In a three-dimensional representation of the measured intensity against the horizontal and vertical positions of the pixels in the two-dimensional measurement zone, the intensity profile can thus be represented as a curved area having high plateaus in the region of light cigarette areas, for example in the region of the light end areas of the cigarettes, and valleys for the regions with low measurement intensities, for example in the region of the cigarette interspaces.

In a method according to the invention, this relief-like changeover of mountains with high plateaus and valleys is evaluated in such a way that, in the case where the measurement zone is arranged on the tobacco side, the presence of a large number of small adjacent intensity values is used as an indicator of recesses in the filling of the cigarettes with tobacco. In this checking method, therefore, valleys, that is to say a real regions with small adjacent intensity values, are deliberately sought. In the region of a valley, an a real shadow region is present at the tobacco-side end of the cigarette. This can be assessed as an indicator of recesses in the filling of the cigarettes, so-called voids.

If a cigarette is missing from a cigarette group and the cigarettes are checked in the region of the filter-side end areas of the cigarettes, the fact that a cigarette is missing from the cigarette group has the consequence that a "valley" with low measurement intensities is present in the region at which a plateau with high intensity should be present for a complete cigarette group. Therefore, in the region of the desired positions of the end filter areas, a large number of low measurement intensities are measured instead of a large number of adjacent high measurement intensities. In the case of the determination of the frequency distribution of the measured values with measurement intensities within predefined intensity classes, the occurrence of a large frequency in conjunction with large measurement intensities indicates the presence of a light filter area, while the presence of large frequencies in conjunction with small measurement intensities can be evaluated as an indicator of a dark cigarette interspace. Further methods relate to preferred refinements of the invention.

Further details of the methods are explained in more detail below using the exemplary embodiments illustrated in the drawings, in which.

Figure 3:
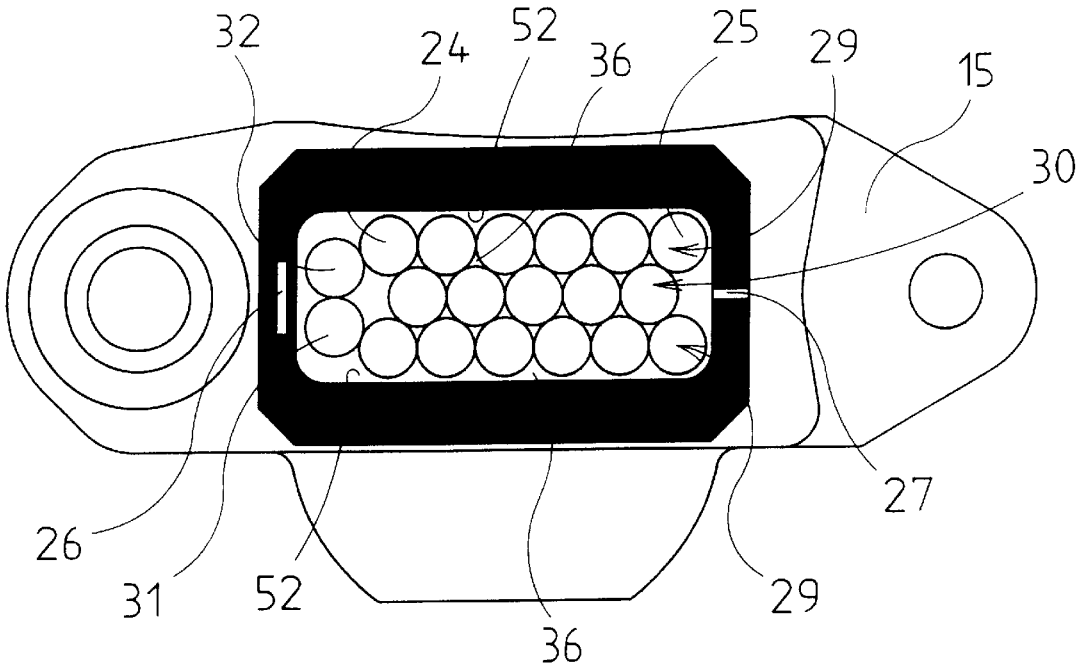
Figure 4:
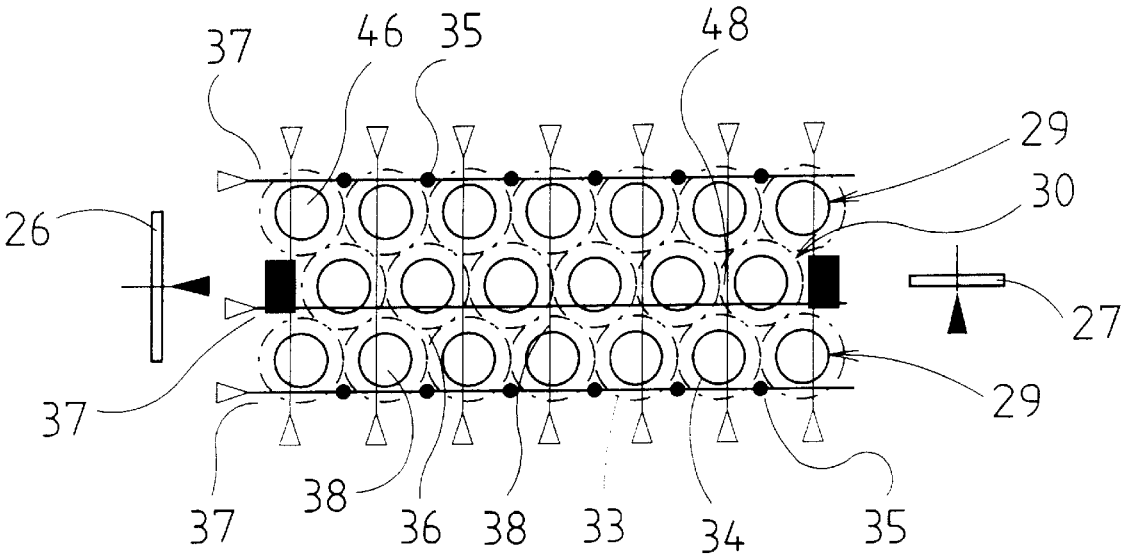
Figure 5:
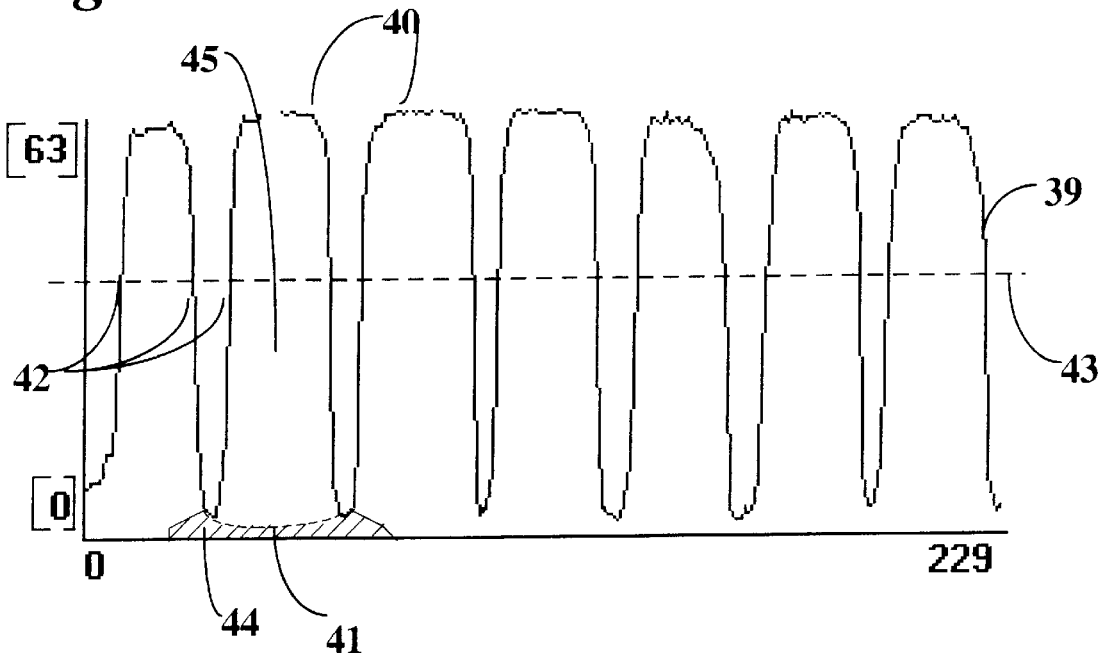
Figure 6:
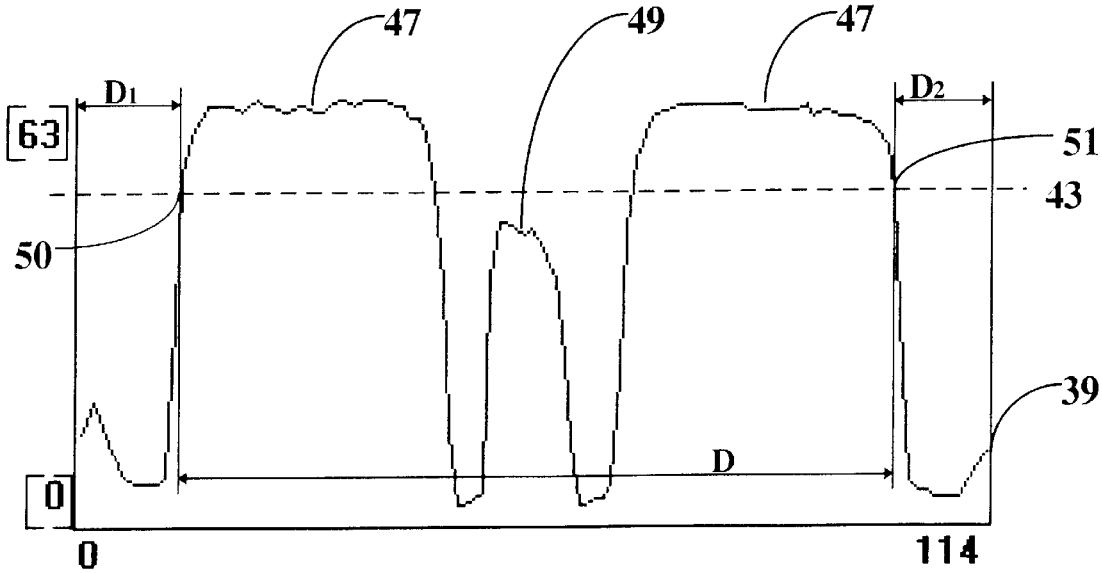
Figure 7:
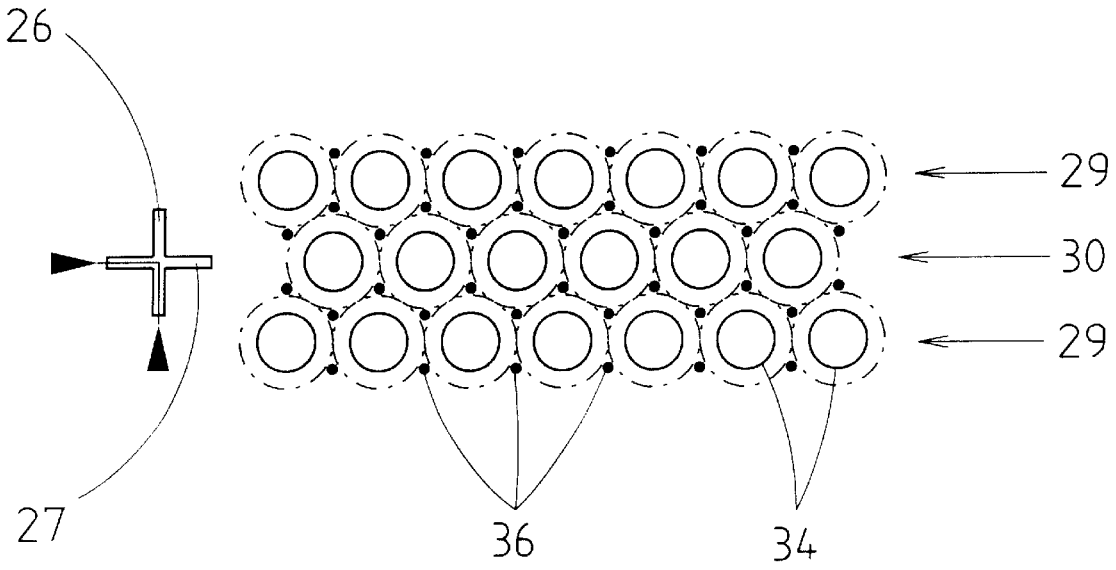
Figure 8:
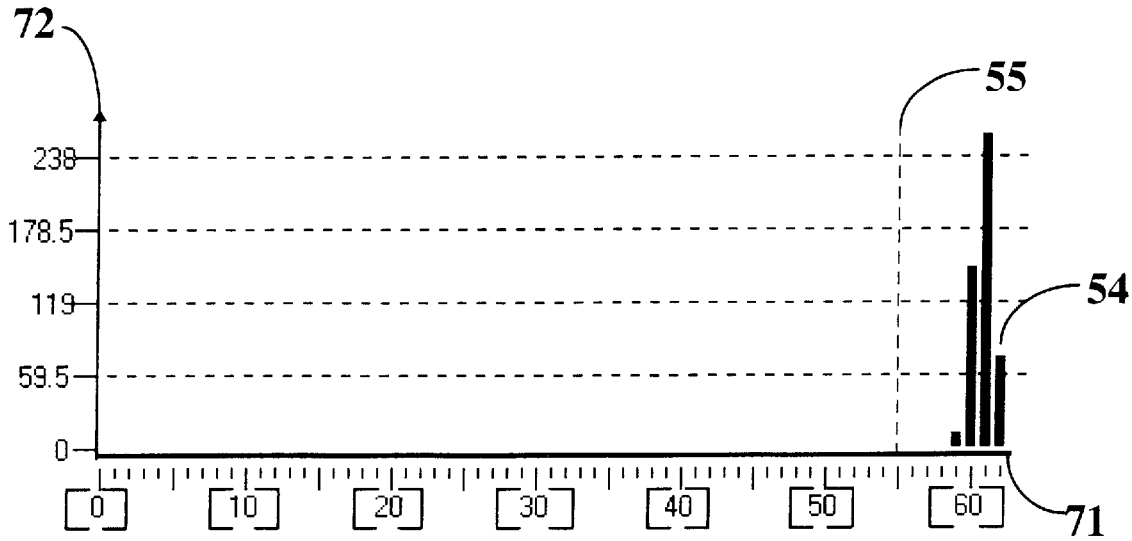
Figure 9:
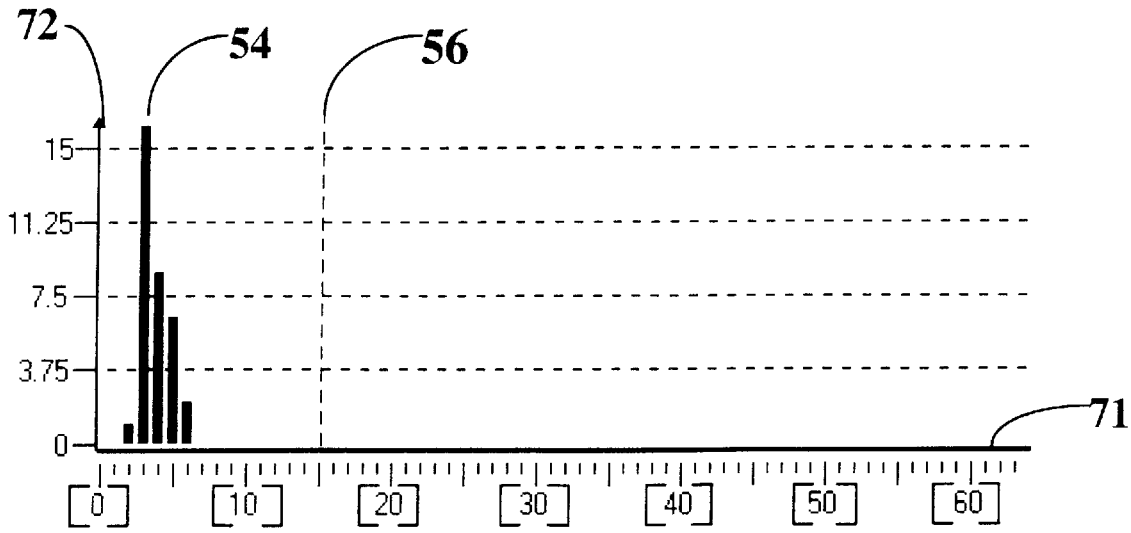
Figure 11:
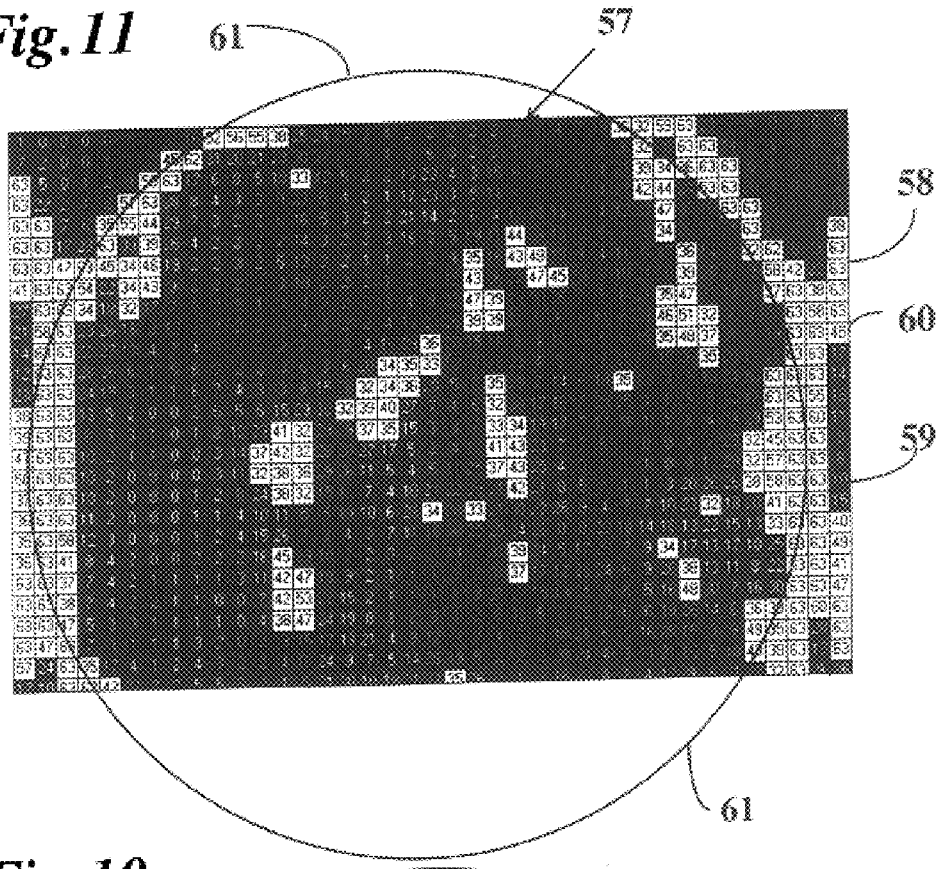
Figure 10:
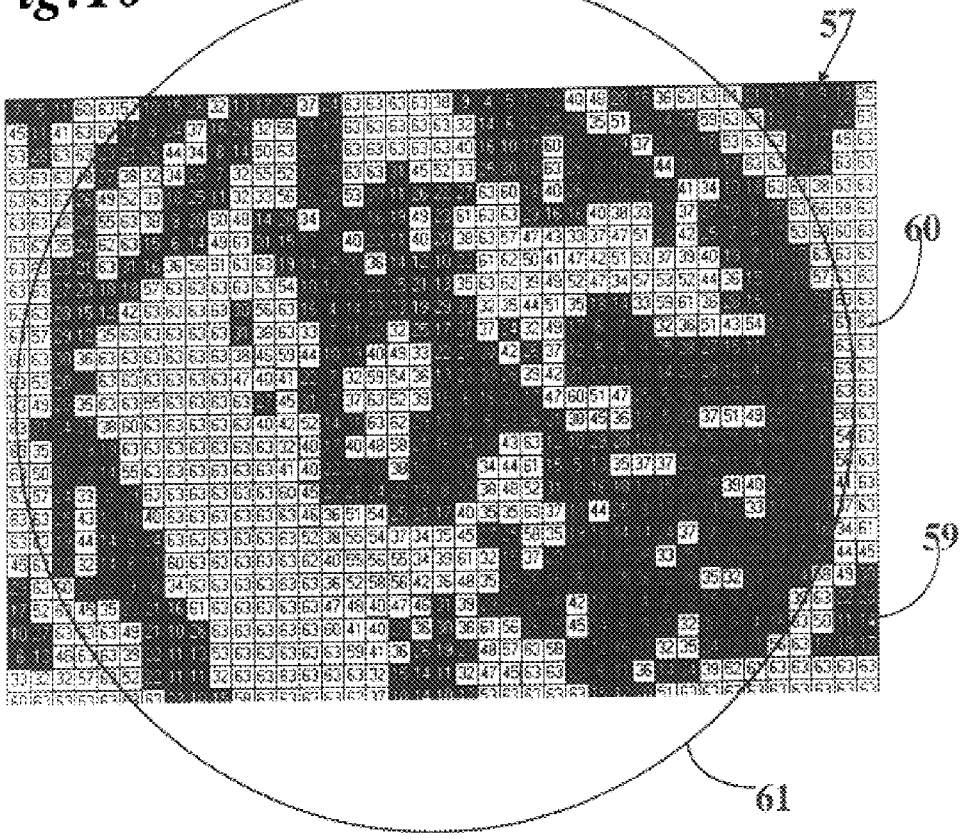
Figure 12:
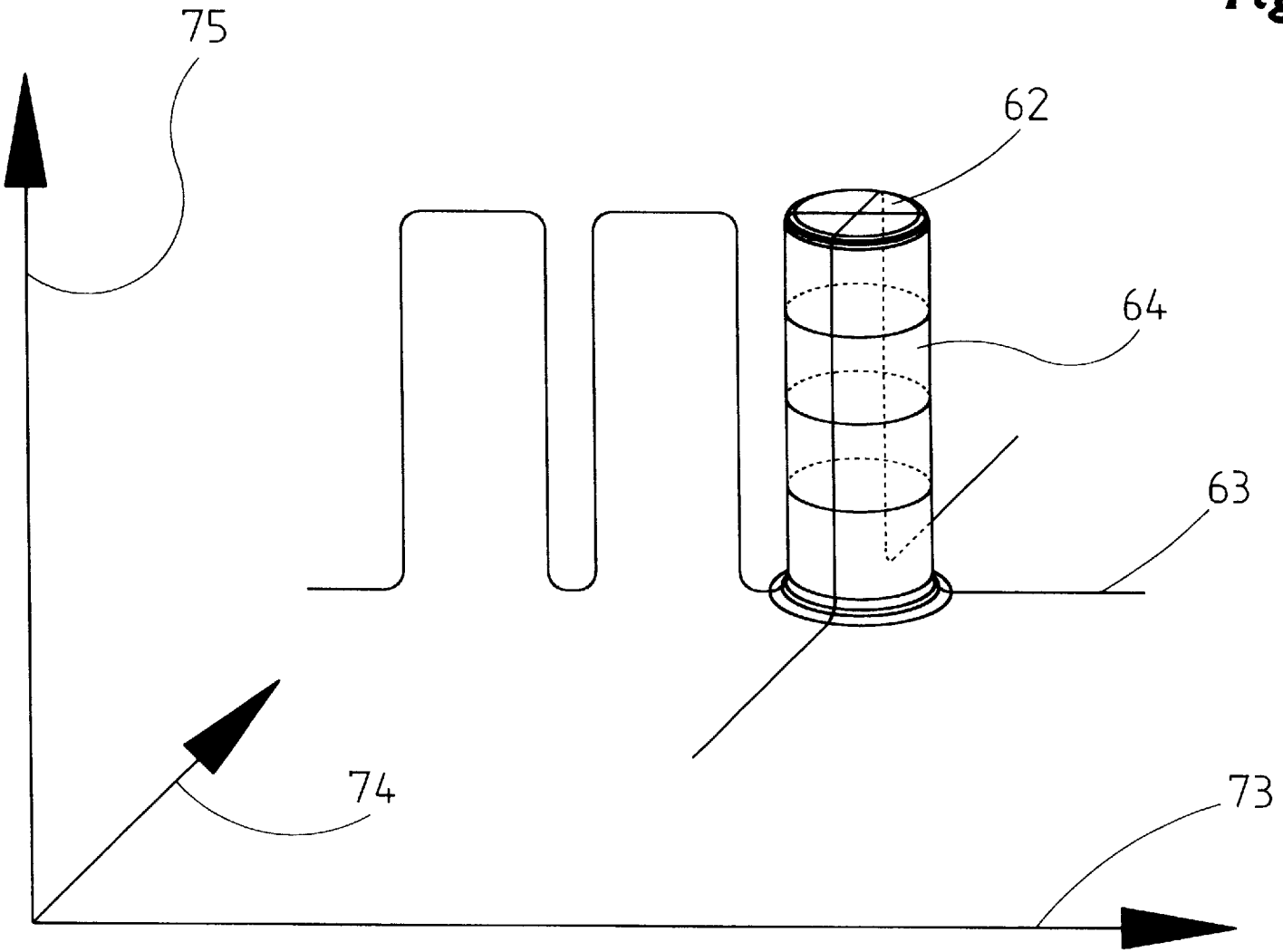
Figure 13:
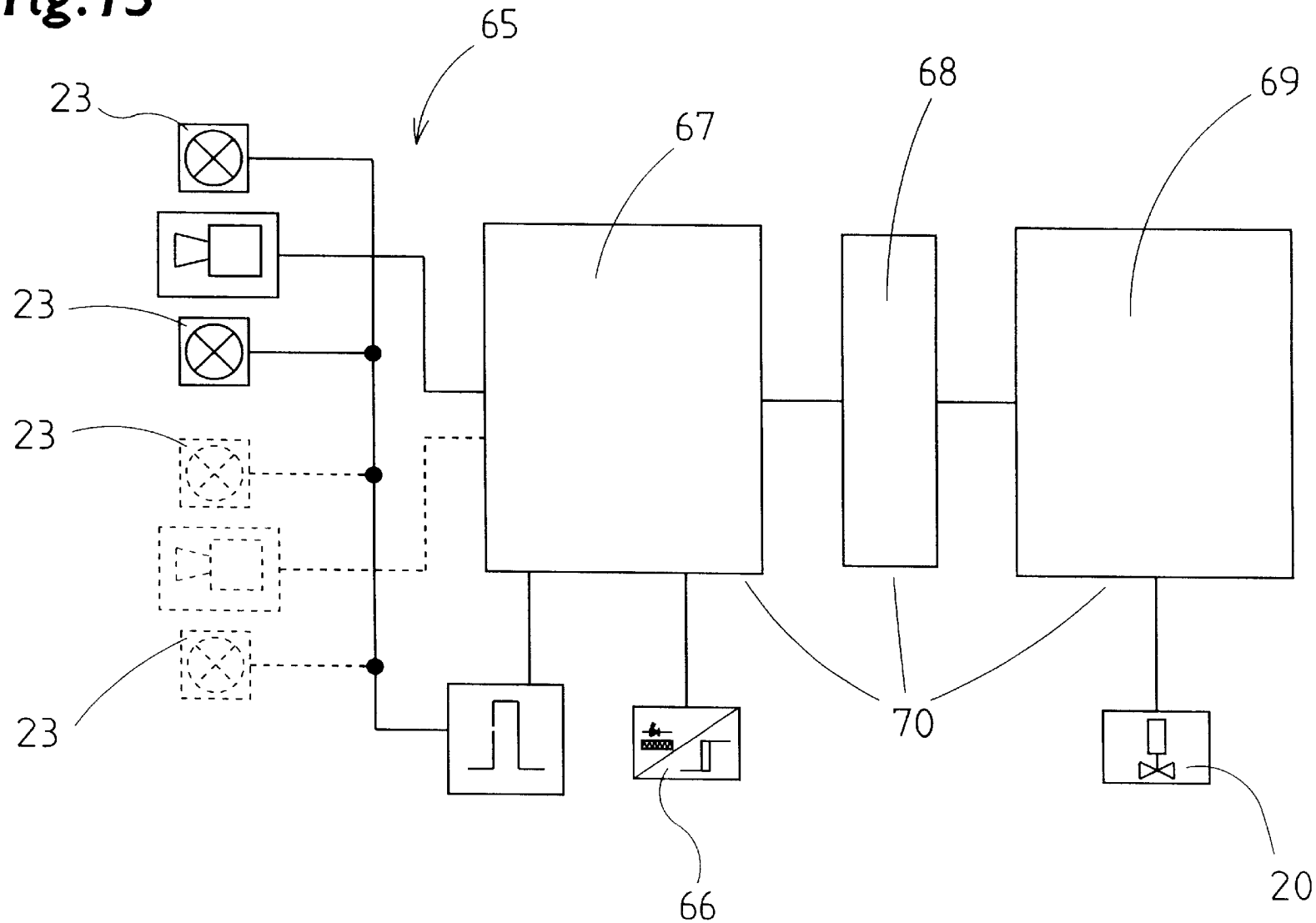

FIG. 3 shows a defective cigarette group in the pocket of a pocket conveyor, FIG. 4 shows horizontal and vertical evaluation bars for checking a cigarette group, FIG. 5 shows an example of a measured intensity signal along a horizontal evaluation bar, FIG. 6 shows an example of a measured intensity signal along a vertical evaluation bar, FIG. 7 shows measurement regions of the checking method in the filter region and in the region of t he cigarette interspaces, FIG. 8 shows the frequency distribution of measured intensities in the filter region, FIG. 9 shows the frequency distribution of measured intensities in the region of the cigarette interspaces, FIG. 10 shows the measurement result from the CCD camera, measured at the tobacco-side en d in the region of a correctly filled cigarette group, FIG. 11 shows the measurement result from the CCD camera, measured at the tobacco-side end in the region of an incorrectly filled cigarette group, FIG. 12 shows a three-dimensional representation of the intensity profile, FIG. 13 shows a block diagram of the measurement control and signal data processing arrangement for monitoring that the cigarette group is complete and filled.

Figure 1:
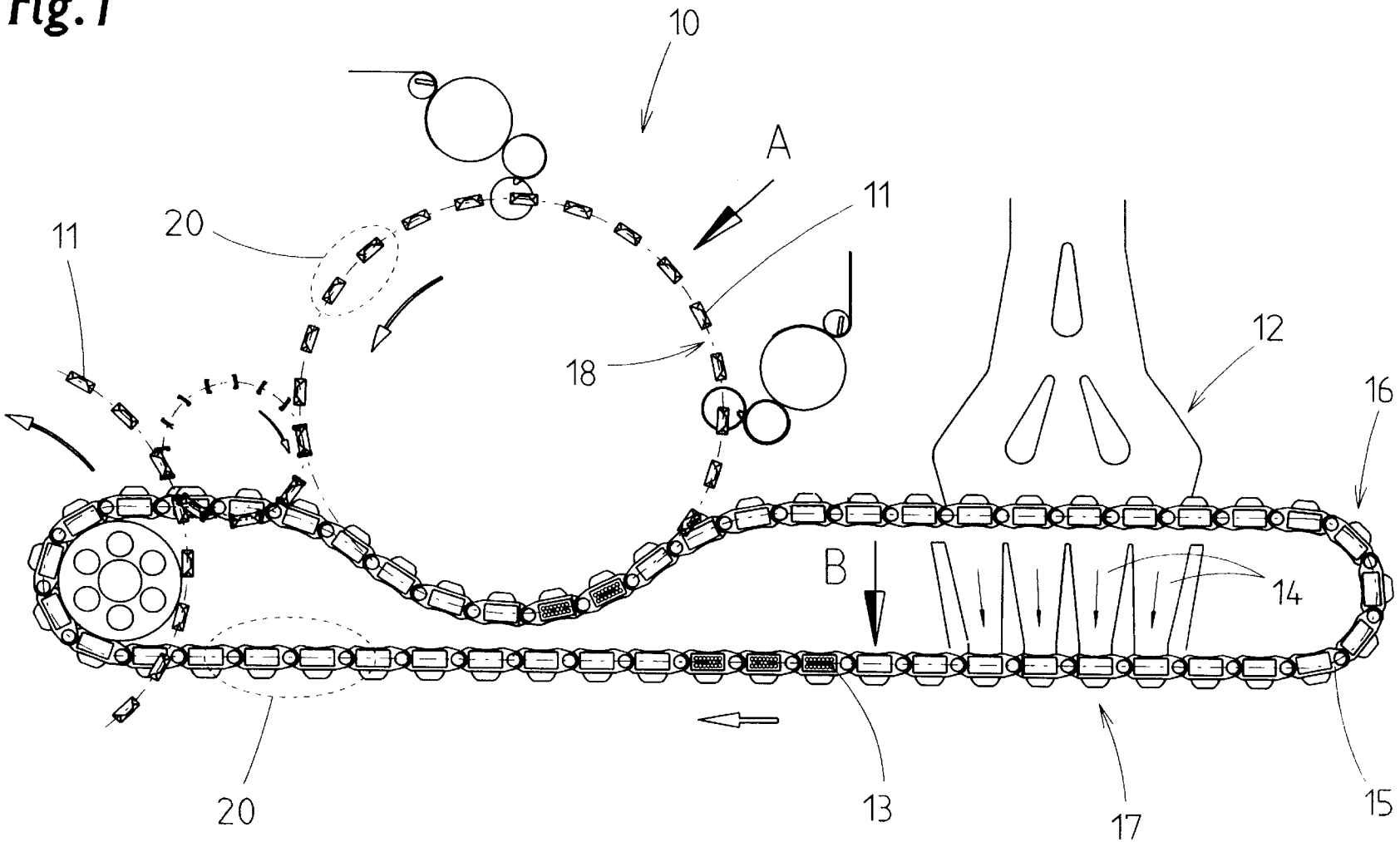
FIG. 1 shows a conveying device for soft-carton packs in side view.

The details illustrated in the drawings relate to a preferred application example, namely to the manufacturing of cigarette packs of the soft-carton pack type. FIG. 1 shows the basic design of a packaging machine 10 for manufacturing such cigarette packs 11. The cigarettes are transferred to the packaging machine 10 in the region of a cigarette magazine 12. This is a customary element in packaging machines 10 for cigarettes for storing cigarettes and for delivering cigarette groups 13 in accordance with the content of a cigarette pack 11. For this purpose, the cigarette magazine 12 is provided with magazine shafts 14 in the lower region, which are combined as shaft groups. A cigarette group 13 is pushed by slides out of each shaft group and into pockets 15 of a pocket chain 16, to be precise in the region of a lower conveying strand 17.

The pocket chain 16 transports the cigarette groups 13 to a folding turret 18, to which they are transferred by being pushed out of the pockets 15 of the pocket chain 16. Details of the structure of the cigarette magazine 12, the pocket chain 16 and the folding turret 18 can be found in EP 226 872.

At the positions in the conveying stream which are marked by the arrows A and B, namely in the region of the lower conveying strand 17 and in the folding turret 18, the cigarette groups 13 are checked to see whether they are complete or whether the cigarettes are completely filled, by means of the checking method according to the invention. An ejector 20 is arranged downstream of the checking device 19 in the conveying direction, which ejector is actuated in the event of an error signal from the checking device 19 for the purpose of separating out defective cigarette groups 13.

Figure 2:
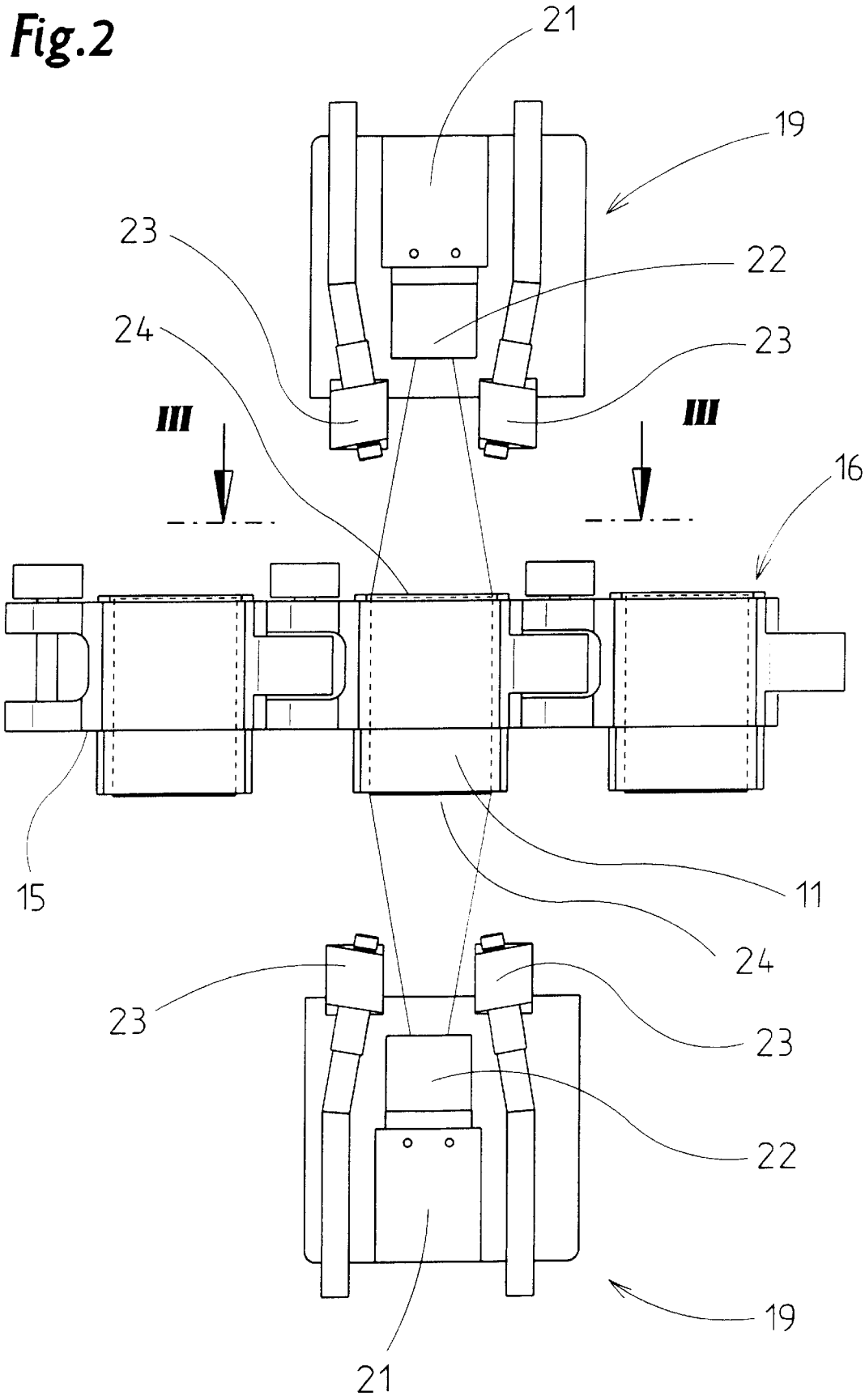
FIG. 2 shows a checking device for checking cigarette groups in plan view.

The checking device has a checking element 21, preferably a CCD linear array chip or a CCD camera. An optical arrangement 22 is arranged upstream of the checking element 21. Other parts of the checking device are, by way of example, two light sources 23, which are preferably inclined at an angle of 5 to 15° with respect to the recording direction of the checking element 21. Checking element 21 and assigned light sources 23 are oriented in such a way that the light from the light sources 23 which is reflected from an end 24 of the cigarette pack 11 is detected by the checking element 21. In this case, the light source 23, preferably a high-intensity light source or a laser, can be activated stroboscopically in time with the machine cycle. In the exemplary embodiment illustrated in FIG. 2, a checking device 19 is arranged at the filter-side end 24 of the cigarette packs 11. The cigarette group is monitored for completeness here, for example. A further checking device is arranged at the tobacco-side end 24 of a cigarette group 13. This further checking device can be used for example to monitor that individual cigarettes 25 are completely filled; however, it is also possible to effect simultaneous monitoring to see whether the cigarette group 13 is complete and the cigarettes 25 are filled with tobacco.

FIG. 3 shows the filter-side end 24 of a cigarette group 13 and also a pocket 15 of the pocket chain 16, the said pocket being assigned to the cigarette group 13. At the pocket 16, provision is made of a vertical marking 26 and a horizontal marking 27 for the orientation of the image of the checking element 21. If the pocket 15 is displaced vertically, the horizontal marking 27 is displaced vertically; if there is a short time delay during the recording of an intensity profile 28 by the checking element 21, that is to say the CCD camera or the CCD linear array chip, the vertical marking 26 is displaced laterally from its desired position in the recorded image. The image recorded by the CCD camera is oriented using the markings in the coordinate system of the evaluation unit.

By way of example, a complete cigarette group 13 has seven cigarettes 25 in each outer horizontal row 29 of cigarettes and the inner horizontal row 30 of cigarettes comprises six cigarettes. Consequently, the cigarette group 13 illustrated is a defective group. On account of a missing cigarette in the inner row 30 of cigarettes, two cigarettes 31 and 32 from the outer rows 29 of cigarettes have been displaced into the interior of the pocket 15 in a manner deviating from their desired positions. Such defective groups are separated out using the following measurement regions:

- the dash-dotted circles 33 mark the desired positions of the cigarettes in the cigarette group,
- the circular areas with a solid border 34 are partial areas of the cigarette end, whose significance for the evaluation method is explained below,
- further evaluation areas are the shadow areas 35 marked by black circular areas in the region of the cigarette interspaces 36, in FIG. 4, horizontal lines mark horizontal evaluation bars 37, which preferably run in such a way that an evaluation bar passes through not only the region of the desired position of each cigarette 33 in a row 29 or 30 of cigarettes but also a shadow region 35 in the region of two adjacent cigarettes in a row 29 or 30 of cigarettes, vertical evaluation bars 38 are preferably arranged in such a way that the cigarette interspaces 36 between cigarettes of adjacent rows of cigarettes are traversed in the vertical direction.

The circular areas 34 and shadow regions 35 can, of course, also have a contour which differs from the circular form illustrated. To determine the completeness of a row 29, 30 of cigarettes, the light intensity reflected along a horizontal evaluation bar 37 is measured by a checking element 21 in an evaluation method according to the invention. To that end, the evaluation bar 37 is imaged by a plurality of pixels of the CCD linear array chip or CCD camera. In this case, each pixel detects the light intensity of a partial section of the evaluation bar 37. In FIG. 5, the horizontal evaluation bar 37 is divided into 230 partial sections of the same size by 230 pixels. The measurement signal 39 illustrated represents the measured intensity for the pixels 0 to 229. The light intensity is usually specified in the candela unit. The CCD camera converts the intensity at the measurement location into a proportional measurement signal, for example into a voltage. For this reason, the measured values for the intensities are specified without units below. The absolute values of the measured values are denoted by square brackets in the text below.

The intensity of the reflected light is large in the region of the pixels assigned to the (light) ends 24 or filters of the cigarettes; in this respect, see the high-intensity plateaus 40 in FIG. 5. The intensity dips in the region of the pixels assigned to the shadow regions 35 between the cigarettes 25. The measured error signal 41 for the case where a cigarette is missing is represented here by a dash-dotted line.

By way of example, the method for evaluating the measurement signal 39 can count the crossings 42 of the measurement signal through a threshold value 43. In the example illustrated, the measurement signal 39 passes through the threshold value 43 seven times in the positive and negative directions. There are thus seven cigarettes in the row 29, 30 of cigarettes.

A further method determines the area under the measurement signal 39 illustrated in FIG. 5. The said area can be determined by summation of the intensities measured by the pixels 0 to 229. The deviation of a sum determined in this way from a desired value can be assessed as an indicator of the fact that a cigarette 25 is missing in the row 29, 30 of cigarettes, since, in the region of the error signal 41 marked by the dash-dotted line, on account of the missing cigarette 25, the error area 44 under the curve is very much smaller than the comparison area 45, in other words only small values enter into the summation.

In a further evaluation method, the intensity measured by pixels assigned to the vertical evaluation bars 38 is evaluated; in this respect see FIG. 6. The vertical evaluation bars 38 pass through the cigarette end areas preferably in the immediate vicinity of the end area midpoint 46. The two high-intensity plateaus 47 in the measurement signal 39 illustrated in FIG. 6 in this case identify measurements in the region of an end 24. The edge region 48 of a cigarette 25 in the inner row 30 of cigarettes is passed through between the two plateaus 47, so that here the intensity rises over a smaller width and forms a local maximum 49. In accordance with the method outlined above, the exceeding or undershooting of a threshold value 43 can be used for evaluation purposes in this case, too. In a simplification of this method, however, only the first crossing 50 of the measurement signal 39 through the threshold value 43 and the last crossing 51 of the measurement signal 39 through the threshold value 43 are evaluated. The distances D1 and D2 can be determined from the pixel assigned to this first crossing 50 and last crossing 51, respectively. As an alternative, the first crossing can, of course, also be determined from both sides or from above and from below (with regard to the measurement direction, also see the arrows in FIG. 4).

The fact that a cigarette 25 is missing in the cigarette group 13 has the consequence that the distance between adjacent cigarettes 25 and the side wall 52 of the pocket 15 is increased; in this case, see cigarettes 31 and 32 in FIG. 3. This results in an increase in the distances D1 and D2. An error signal can be determined from the comparison of the sum D1+D2 with a desired value. By analogy with this, it is also possible, of course, to use the distance D between the first crossing 50 and the last crossing 51 for the evaluation.

Problems may be posed by the application of the checking method described to the case of checking the cigarette group 13 in the region of the folding turret 18. In the folding turret, the cigarette groups 13 are not surrounded by dark pockets 15, but rather by light packaging material. Consequently, it can happen that the measurement signal 39 has high intensities outside the cigarette group 13 and, for this reason, a first and a last crossing 50, 51 are not present. In this case, it is possible to use a further method for determining the completeness of the cigarette group 13, which method is based on the intensities measured in the partial area, namely circular area 34 of the end 24 and the shadow regions 35. In this case, a plurality of pixels are arranged in the circular areas 24 of the filter-side end area of a cigarette. The light filter-side ends 24 reflect light with a high intensity, for example intensities between [59] and [63], see FIG. 8. For the evaluation of the intensities measured in pixels assigned to the partial areas of the end 24, a plurality of classes 54 of intensity are formed, for example classes 54 having intensity values in the region of [59]–[60], [60]–[61] and [61]–[62]. In the measurement result illustrated in FIG. 8, the frequency N of the pixels is represented for each intensity class for a measurement in the region of the filter-side end 24, the frequency 72 being plotted against the intensity class 71. An intensity >[60] was thus measured for more than 238 pixels. In this case, the number of pixels with intensities below a threshold value is approximately zero if the filter-side end 24 of the cigarette 25 is situated in the desired position (in practice, the intensity below a threshold value is approximately zero on account of measurement inaccuracies).

If a cigarette 25 is missing from the cigarette group 13, the remaining cigarettes 25 of the cigarette group 13 are displaced. The consequence of this is that shadow regions 35 are displaced into the light filter-side desired positions of the cigarettes 33. Therefore, if measured values with intensities below the threshold value 55 are present, this can be evaluated as an indicator of an erroneous position of one or more cigarettes 25. In the case of digitized intensity values, the classes can also be formed from the digitization levels, so that pixels of the same intensity are then summed.

For measurements in the shadow region 35 in the cigarette interspace 36 between adjacent cigarettes 25, the intensity of the reflected light is very small; in this respect, see FIG. 9. The number of pixels is smaller in this case, since the assigned measurement areas for the shadow regions 35 are smaller. For a partial area of the measurement zone which lies in the desired region of the shadow regions 35, the number of pixels with intensities greater than a predefined threshold value 56 is zero. The displacement of the remaining cigarettes 25 from their desired position 33 due to a cigarette 25 being missing from the cigarette group 13 has the consequence that light filter areas are arranged in the desired positions 33 of the shadow regions 35. Therefore, if measured values with intensities above a threshold value 56 are present for measurements in the shadow region 35, this can be evaluated as an indicator of the erroneous position of one or more cigarettes 25.

In a further measurement method, a measurement area 57, in the region of the tobacco-side end 24 of the cigarette group 13, is divided into a plurality of pixel areas 58, to each of which a pixel of the CCD camera is assigned. FIG. 10 shows an enlarged detail of the measurement area 57, in which each square describes the pixel area 58 detected by a pixel and the numerical value assigned to this square describes the brightness measured in the pixel area 58. In this case, dark pixel areas 58 identify regions with low intensities, that is to say dark end-area regions, and bright pixel areas 60 identify light measurement areas.

In this case, the circular contours 61 formed by pixels with high measurement intensities correspond to the outer contour of the cigarettes 25, since the light casing around the tobacco reflects light with high intensity. Inside the casing, the intensity fluctuates very greatly at average values. This can be attributed to the fact that the end 24 formed by the tobacco is uneven. In this case, FIG. 10 illustrates the measurement result of correctly formed cigarettes 25. In the region of the end 24 of the cigarette 25 formed by the tobacco, the intensity fluctuates very greatly, but there are no large areas with low intensity which are formed by a plurality of adjacent pixel areas 58. If the cigarettes are deficiently filled with tobacco, recesses may be formed from the end area of the cigarettes. These regions are identified by regions with a low measurement intensity which are formed from a plurality of pixel areas 58; in this respect, cf. FIG. 11. Counting the number of adjacent pixel areas 58 with intensities below a predefined threshold value can thus be used as an indicator of inadequately filled cigarettes 25.

FIG. 12 shows a detail from the result of the intensity measurement by means of the checking element, for example a CCD camera, with arrangement on the filter side. In this case, the intensity 75 is plotted against the x-axis 73 and the y-axis 74, that is to say as a function of the horizontal and vertical measurement positions. In this case, the plateaus 62 with high intensities can be discerned in the region of the light filter-side ends 24. Each plateau 62 is formed by the measured intensities of many pixels, in this case approximately 500. In the dark shadow regions 35 of adjacent cigarettes 25, valleys 63 are formed in the three-dimensional representation. In the case of a correctly formed cigarette group 13, 7+6+7=20 such plateaus 62 separated by valleys 63 are accordingly present; if a cigarette 25 is missing, one plateau 62 is replaced by an additional valley 63. The volume under a measurement area 64 produced in this way is dependent on the number of plateaus 62. Accordingly, the deviation of the volume that has been determined from a desired value can be evaluated as an indicator of missing cigarettes 25. The determination of the volume is in this case proportional to the sum of the individual intensities measured in the measurement area 64, so that the volume or an amount proportional thereto can be determined in a simple manner. It goes without saying that an evaluation method of this type can also be carried out at the tobacco-side ends 24 of the cigarette group 13, so that the checking of the completeness of the cigarette group 13 and of the filling of the cigarettes 25 can be effected by one checking element 21 in this case.

In order to increase the reliability of the checking method, it is also possible, of course, for a plurality of the checking methods that have been explained to be used simultaneously.

The measurement methods that have been explained have the following block diagram 65 for the signal data processing and the machine control in common, see FIG. 13:

The checking operation is started by a trigger signal 66, which is generated for example by a light barrier when a new pocket 15 with cigarette group 13 enters the checking region. This trigger signal 66 is fed to the image processing arrangement 67, which activates a light source 23, for example a laser, stroboscopically. At the same time as the cigarette group 13 is exposed to the flashing, an image is recorded by means of the checking element 21, for example a CCD linear array chip or a CCD camera, and fed to the image processing arrangement 67. This image is fed via a suitable I/O interface 68 to the machine control 69. In addition to monitoring that the cigarette group 13 is complete and that the cigarettes 25 are filled with tobacco, the signal data processing arrangement 70 must also monitor whether the checking elements 21 are operationally available, the image from the checking element 21 is recorded at the correct instant and/or the signal quality is sufficient. By way of example, in the event of deficient light conditions on account of a defective light source 23, an error signal must be generated, so that the machine can be stopped and the light source 23 exchanged. The machine control 69 is furthermore connected to an ejector 71, so that if an incomplete cigarette group 13 or incomplete filling of the cigarettes 25 is identified, the ejector 71 can be actuated for the removal of the defective cigarette group 13. It goes without saying that a plurality of separate checking devices 19 can also be activated and evaluated simultaneously or successively.

LIST OF REFERENCE SYMBOLS

10 Packaging machine
11 Cigarette pack
12 Cigarette magazine
13 Cigarette group
14 Magazine shaft
15 Pocket
16 Pocket chain
17 Lower conveying strand
18 Folding turret
19 Checking device
20 Jector
21 Checking element
22 Optical arrangement
23 Light source
24 End
25 Cigarette
26 Vertical marking
27 Horizontal marking
28 Intensity profile
29 Outer row of cigarettes
30 Inner row of cigarettes
31 Cigarette
32 Cigarette
33 Desired position of the cigarette
34 Circular area
35 Shadow region
36 Cigarette interspace
37 Horizontal evaluation bar

38 Vertical evaluation bar
39 Measurement signal
40 Plateau
41 Error signal
42 Crossing
43 Threshold value
44 Error area
45 Comparison area
46 End area midpoint
47 Plateau
48 Edge region
49 Local maximum
50 First crossing
51 Last crossing
52 Side wall
53 Filter
54 Class
55 Threshold value
56 Threshold value
57 Measurement area
58 Pixel area
59 Dark pixel area
60 Bright pixel area
61 Circular contour
62 Plateau
63 Valley
64 Measurement curve
65 Block diagram
66 Trigger signal
67 Image processing arrangement
68 I/O interface
69 Machine control
70 Signal data processing arrangement
71 Intensity class
72 Frequency
73 x-axis
74 y-axis
75 Intensity

What is claimed is:

1. Method for checking ordered cigarette groups (13) corresponding to the content of a cigarette pack (11), where an intensity of light reflected by ends (24) of cigarettes (25) is measured by an electro-optical checking element (21) connected to a signal data processing arrangement (70), using a measurement zone formed with pixels, the measurement zone is assigned to at least one partial area of the ends (24) of the cigarettes (25) and cigarette interspaces (36) formed between the latter, a measurement signal (39) is measured in the measurement zone and evaluated in the signal data processing arrangement (70), characterized in that the measurement signal (39) is measured along at least one linear, curved or rectilinear evaluation bar (37, 38) and is evaluated in order to check whether the cigarette group (13) is complete, the number of cigarettes (25) in the region of the evaluation bar or bars (37,38) is determined from a count of crossings (42) of the measurement signal (39), measured along the evaluation bar (37,38), through a threshold value (43) with the threshold value (43) subsequently being exceeded and/or undershot, and if the cigarette groups (13) are incomplete, an error signal is generated which is fed to an ejector (71) arranged downstream of a checking device (19) in a conveying direction.

2. Method according to claim 1, characterized in that said evaluation bar (37, 38) runs horizontal or vertical with respect to a horizontal row (29, 30) of said cigarette group (13) across said cigarette group (13).

3. Method according to claim 2, characterized in that said horizontal or vertical evaluation bar (37, 38) runs along interspaces (35, 36) between adjacent cigarettes (25) of said ordered cigarette groups (13).

4. Method according to claim 3, characterized in that said horizontal or vertical evaluation bar (37, 38) runs along desired positions (33) of said cigarettes (25).

5. Method according to claim 4, characterized in that said vertical evaluation bar (38) runs along an end area of said cigarettes (25) in an immediate vicinity of a midpoint (46) of said end areas of said cigarettes (25).

6. Method according to claim 1, characterized in that the measurement signal (39) is recorded and processed during a machine cycle in which a respective cigarette group is processed.

7. Method according to claim 6, characterized in that said recording and processing of the measurement signal (39) are initiated by a trigger signal (66) of a light barrier at the instant when a cigarette group (13) enters a checking region.

8. Method according to claim 1, characterized in that the measurement signal is recorded and processed by one or more measurement and evaluation devices simultaneously for at least one or more cigarette groups (13).

9. Method according to claim 1, characterized in that the evaluation bars (37, 38) or the measurement zone is oriented with the aid of markings (26, 27) arranged in the region or surroundings of the cigarette groups (13).

10. Method according to claim 9, characterized in that said markings (26,27) are horizontal or vertical.

11. Method for checking ordered cigarette groups (13) corresponding to the content of a cigarette pack (11), where an intensity of light reflected by ends (24) of cigarettes (25) is measured by an electro-optical element (21) connected to a signal data processing arrangement (70), using a measurement zone formed from pixels, the measurement zone is assigned to at least one partial area of the ends (24) of the cigarettes (25) and cigarette interspaces (36) formed between the latter, a measurement signal (39) is measured in the measurement zone and evaluated in the signal data processing arrangement (70), characterized in that the measurement signal (39) is measured along at least one linear, curved or rectilinear evaluation bar (37, 38) and is evaluated in order to check whether the cigarette group (13) is complete, and the completeness of the cigarette group (13) is determined from a comparison of a distance (D) between a first and a last crossing of the measurement signal (39) through a threshold value (43) with a desired value.

12. Method according to claim 11, characterized in that said evaluation bar (37, 38) runs horizontal or vertical with respect to a horizontal row (29, 30) of said cigarette group (13) across said cigarette group (13).

13. Method according to claim 12, characterized in that said horizontal or vertical evaluation bar (37, 38) runs along interspaces (35, 36) between adjacent cigarettes (25) of said ordered cigarette groups (13).

14. Method according to claim 13, characterized in that said horizontal or vertical evaluation bar (37, 38) runs along desired positions (33) of said cigarettes (25).

15. Method according to claim 14, characterized in that said vertical evaluation bar (38) runs along an end area of said cigarettes (25) in an immediate vicinity of a midpoint (46) of said end areas of said cigarettes (25).

16. Method according to claim 11, characterized in that, if the cigarette groups (13) are incomplete, an error signal is generated which is fed to an ejector (71) arranged downstream of a checking device (19) in a conveying direction.

17. Method according to claim 11, characterized in that the measurement signal (39) is recorded and processed during a machine cycle in which a respective cigarette group is processed.

18. Method according to claim 17, characterized in that said recording and processing of the measurement signal (39) are initiated by a trigger signal (66) of a light barrier at the instant when a cigarette group (13) enters a checking region.

19. Method according to claim 11, characterized in that the measurement signal is recorded and processed by one or more measurement and evaluation devices simultaneously for at least one or more cigarette groups (13).

20. Method according to claim 11, characterized in that the evaluation bars (37, 38)or the measurement zone is oriented with the aid of markings (26, 27) arranged in the region or surroundings of the cigarette groups (13).

21. Method according to claim 20, characterized in that said markings (26,27) are horizontal or vertical.

22. Method for checking ordered cigarette groups (13) corresponding to the content of a cigarette pack (11), where an intensity of light reflected by ends (24) of cigarettes (25) is measured by an electro-optical checking element (21) connected to a signal data processing arrangement (70), using a measurement zone formed from an array of pixels, the measurement zone is assigned to at least one partial area of the ends (24) of the cigarettes (25) and cigarette interspaces (36) formed between the latter, a measurement signal (39) is measured in the measurement zone and evaluated in the signal data processing arrangement (70), the measurement signal (39) is measured in partial zones of the measurement zone and is evaluated in order to check whether the cigarette group (13) is complete, characterized in that said measurement signal (39) measured in each said pixel of said array of pixels is evaluated in accordance with a horizontal and vertical position of each pixel to obtain a measurement curve (64), and the magnitude of the volume formed under the measurement curve (64) is used as an indicator of missing cigarettes (25).

23. Method according to claim 22, characterized in that, if the cigarette groups (13) are incomplete, an error signal is generated which is fed to an ejector (71) arranged downstream of a checking device (19) in a conveying direction.

24. Method according to claim 22, characterized in that the measurement signal (39) is recorded and processed during a machine cycle in which a respective cigarette group is processed.

25. Method according to claim 24, characterized in that said recording and processing of the measurement signal (39) are initiated by a trigger signal (66) of a light barrier at the instant when a cigarette group (13) enters a checking region.

26. Method according to claim 22, characterized in that the measurement signal is recorded and processed by one or more measurement and elevation devices simultaneously for at least one or more cigarette groups (13).

27. Method according to claim 22, characterized in that the evaluation bars (37, 38) or the measurement zone is oriented with the aid of markings (26, 27) arranged in the region or surroundings of the cigarette groups (13).

28. Method according to claim 27, characterized in that said markings (26,27) are horizontal or vertical.

* * * * *